US005426789A

United States Patent [19]

MacLeod

[11] Patent Number: 5,426,789

[45] Date of Patent: Jun. 27, 1995

[54] SIZE ADJUSTABLE HAT

[75] Inventor: Angus D. MacLeod, Reinholds, Pa.

[73] Assignee: Bollman Hat Company, Adamstown, Pa.

[21] Appl. No.: 312,618

[22] Filed: Sep. 27, 1994

[51] Int. Cl.[6] ..... A42B 1/22

[52] U.S. Cl. ..... 2/175.1; 2/183; 2/195.2

[58] Field of Search ..... 2/171, 175.1, 181, 181.2, 2/181.4, 181.6, 183, 184, 195.1, 195.2, 195.3, 195.4, 417, 418, 420, 909, 918

[56] References Cited

U.S. PATENT DOCUMENTS 1,557,280 10/1925 Watson ..... 2/175.1
1,725,425 8/1929 Steingold ..... 2/183
1,894,213 1/1933 Ostolaza .
2,040,355 5/1936 Wittcoff .
2,445,921 7/1948 Ostolaza et al. .
4,011,600 3/1977 Malk .
4,642,817 2/1987 Ferstenfeld .
5,142,705 9/1992 Edwards .

OTHER PUBLICATIONS

Head-Quarters, pp. 217, 229, 240.

*Primary Examiner*—Clifford D. Crowder
*Assistant Examiner*—Diana L. Biefeld
*Attorney, Agent, or Firm*—Shlesinger, Arkwright, & Garvey

[57] ABSTRACT

This invention relates to a size adjustable hat having an auxiliary sweat band cooperating with the normal sweat band for adjusting the hat to fit comfortably on the head by allowing adjustment to intermediate sizes not presently available in certain styles as for example, small, medium, large and extra-large. The auxiliary sweat band is secured to the main sweat band to provide a smooth comfortable surface to the head of the wearer of the hat. The auxiliary sweat band is so designed as to leave the ends thereof hidden and unobtrusive.

11 Claims, 2 Drawing Sheets

SIZE ADJUSTABLE HAT

BACKGROUND OF THE INVENTION

Adjustable straps for hats have been known for many years. Ostolaza (U.S. Pat. No. 1,894,213) provides an adjustable sweat band which extends from inside of the crown to the outside thereof.

Wittcoff (U.S. Pat. No. 2,040,355) provides an adjustable sweat band with over riding flaps above the adjustable feature.

Ostolaza (U.S. Pat. No. 2,445,921) discloses another adjustable sweat band of a latch engagable type.

Malk (U.S. Pat. No. 4,011,600) shows an adjustable sweat band utilizing VELCRO (trademark) for adjustment purposes as to Ferstenfeld (U.S. Pat. No. 4,642,817) and Edward (U.S. Pat. No. 5,142,705). None of these references provide a strap of auxiliary sweat band, a portion of which is visible with the ends thereof hidden.

OBJECTS AND SUMMARY OF THE INVENTION

It is an object of this invention to provide an auxiliary sweat band for hats which cooperate with the main sweat band for the purpose of permitting different size adjustments.

It is yet another object of this invention to provide an auxiliary sweat band cooperating with the main sweat band to provide maximum comfort at minimum expense in manufacturing.

Still a further object of this invention is to provide an adjustable auxiliary sweat band for hats which uses a minimum amount of material and avoids shifting laterally up and down relative to the longitudinal run of the sweat band.

Another object of this invention is to provide a sweat band which is easily adjusted and which has the ends hidden so as to provide maximum comfort to the wearer.

Still a further object of this invention is to provide an auxiliary sweat band for a hat which will allow ventilation between the main sweat band and the auxiliary sweat band for keeping the head of the wearer cool.

Still a further object of this invention is to provide an adjustable auxiliary sweat band which will not gather, crumple or pucker the crown when adjusted.

Yet another object of this invention is to provide an auxiliary sweat band of soft material similar to that of the main sweat band.

These and other objects of the invention will be apparent from the following description, drawings and claims.

In summary, this present invention relates to a hat, and more particularly to a size adjustable auxiliary sweat band for the purpose of permitting different size adjustments.

DETAILED DESCRIPTION OF THE INVENTION

FIGS. 1-5

Figure 1:
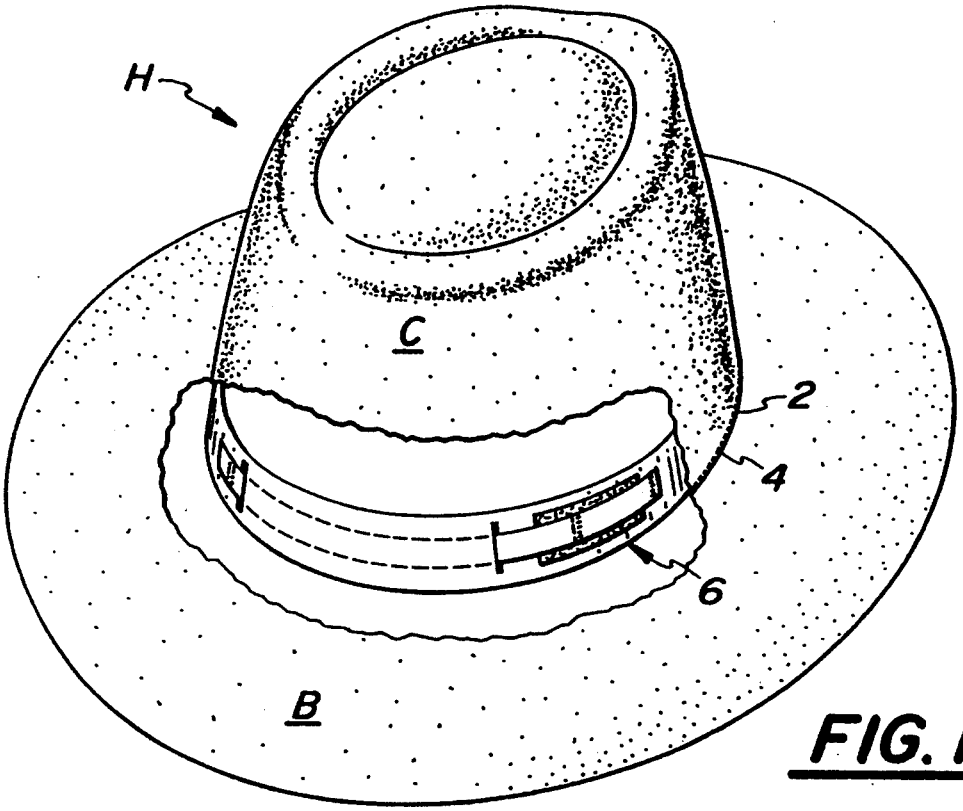
FIG. 1 is a perspective view of the hat with a portion broken away at the crown and the brim showing the main sweat band and the auxiliary sweat band, a portion of which is shown in phantom lines.

FIG. 1 illustrates the hat H having a brim B and a crown C. Secured at the margin 2 by stitching 4 is the main sweat band 6. The sweat band 6 includes a lower edge or edge portion 8, an upper edge or edge portion 10, and a central portion 12.

Figure 5:
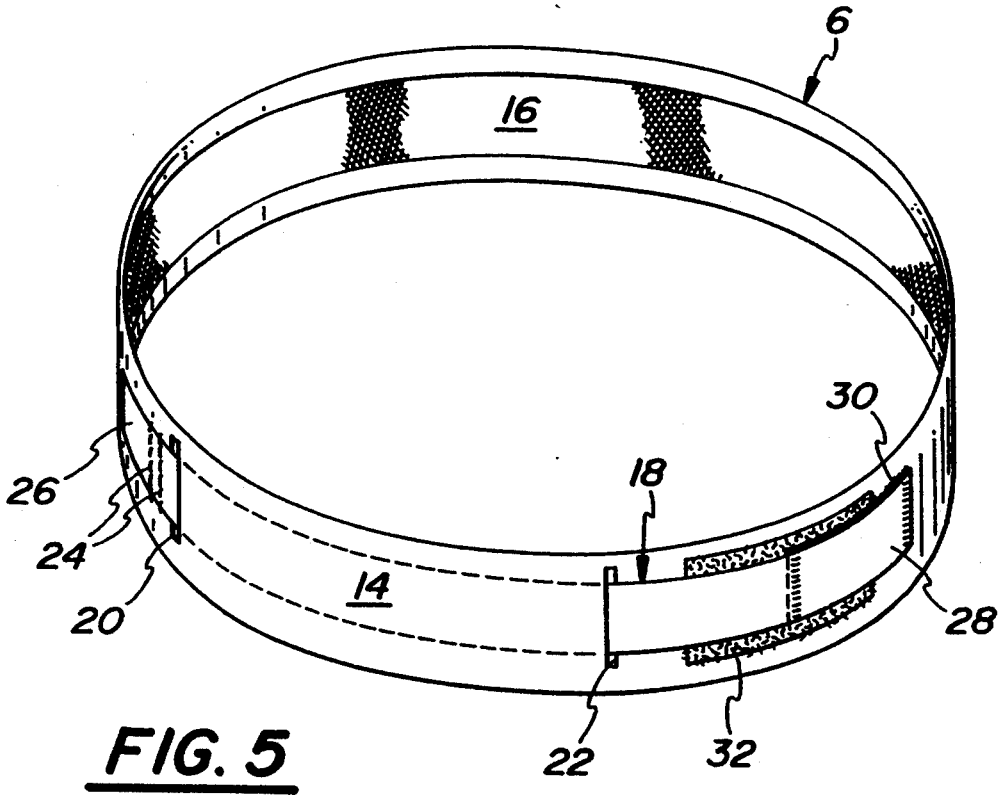
FIG. 5 prostrates is perspective the complete circumferential sweat band with the auxiliary sweat band in position with a part thereof in dash lines.

As best shown in FIG. 5, the sweat band 6 includes an inner surface 14 and an outer surface 16.

The hat H may be made of felt materials or straw or other materials including natural and synthetic fibers.

The sweat band 6 may be made from any substance such as leather, natural and/or man made woven or knitted materials or the like. In general, the sweat band 6 is flexible and designed to absorb perspiration.

Figure 2:
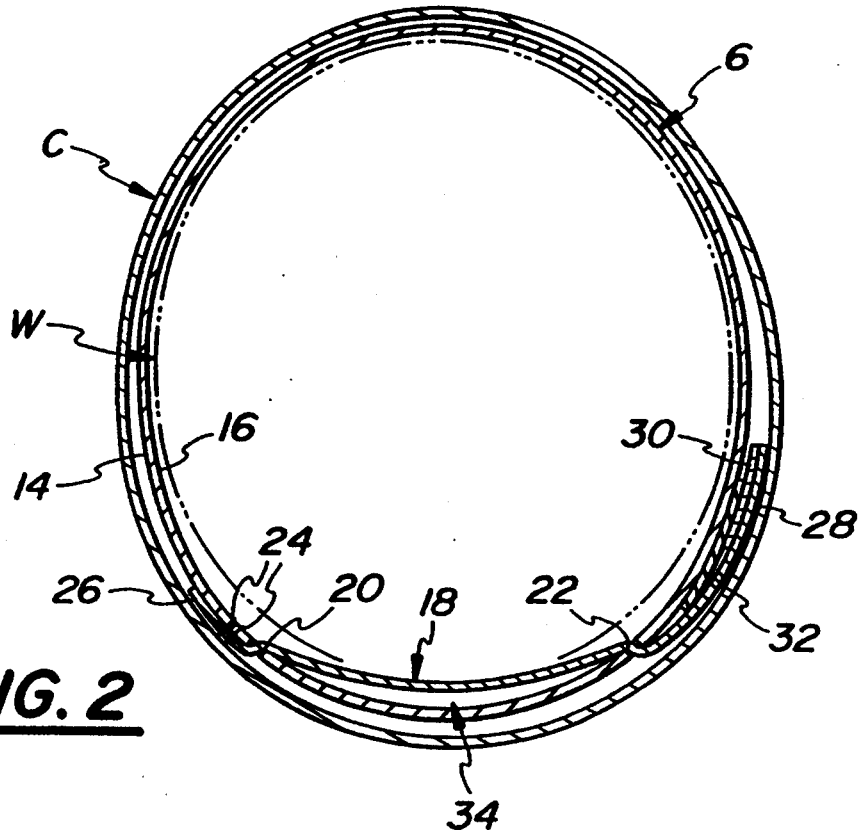
FIG. 2 is a cross-sectional view of a hat taken through the area of the main sweat band and showing the auxiliary sweat band in solid lines and the head of the wearer in broken phantom lines.

In FIG. 2, the wearers head W is illustrated in phantom lines with the front of the head at the top of the drawing and the back of the head at the bottom of the drawing. As further illustrated in FIG. 2, an auxiliary sweat band 18 is secured at the rear of the crown C to the main sweat band 6 as will here and after be described.

Figure 3:
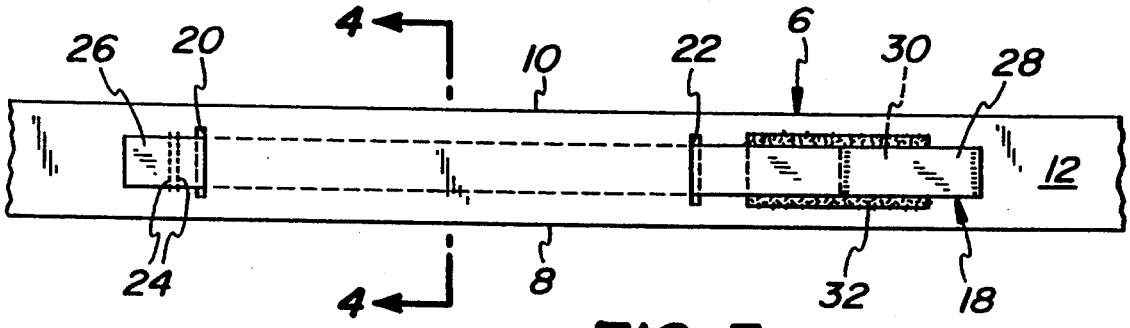
FIG. 3 is a fragmentary elevational view of the sweat band as viewed in the direction of the inner surface of the sweat band and showing a portion of the auxiliary sweat band in dash lines.
Figure 4:
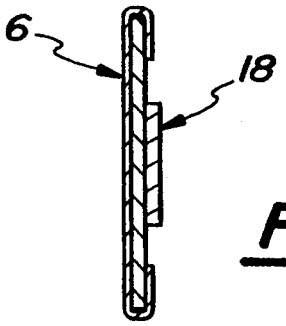
FIG. 4 is a cross-sectional view taken along the line 4-4 of FIG. 3.

Sweat band 6 includes slot or slit openings 20 and 22 which are spaced from each other to the rear of the hat and on either side thereof. The auxiliary sweat band 18 as illustrated in FIG. 3 is substantially less in width then the main sweat band 6 and is positioned in the central portion 12 of the sweat band 6. The auxiliary sweat band 18 may be made of the same material as sweat band 6 or of any other absorbent material soft and flexible and durable as the main sweat band 6. As illustrated best in FIGS. 2 and 3, auxiliary sweat band 18 is secured to sweat band 6 by stitching 24 on the remote side of the opening slot 20. The auxiliary sweat band 18 extends from the inner surface 14 of the sweat band 6 through the slot 20 adjacent to the outer surface of the sweat band 6 and back through the slot or slit opening 22 and once again runs adjacent to the inner surface 14 of the sweat band 6. The fixed end of the auxiliary sweat band does not move in the slot 20. The free end 28 as illustrated in FIG. 3 of the auxiliary sweat band 18 includes a piece of VELCRO (trademark) 30 (either loop or hook) which is mounted on the inside surface of the auxiliary sweat band 18 at the end thereof and comprises a strip approximately an inch to an inch and a half in length which is secured by stitching or any other suitable means. A cooperating VELCRO strip 32 which coacts with VELCRO strip 30 is secured to the inner surface 14 of the sweat band 6 as best shown in FIGS. 2 and 3.

The VELCRO loop strip and the VELCRO hook strip may be of similar dimension or slightly different dimensions both in width and in length though shown in FIG. 5 as having the strip 32 somewhat wider than the free-end VELCRO strip 30 best illustrated in FIG. 2.

OPERATION

In operation, the auxiliary sweat band 18 VELCRO portion 30 is separated from the main sweat band 6 VELCRO portion 32 and adjustment is made as illustrated in FIG. 2 and the two(2) VELCRO portions 30 and 32 secured together. It will be noted in FIG. 2 that a gap 34 will be formed between the auxiliary sweat band 18 and the main sweat band 6. This allows for air to circulate upwardly in the gap around the head, keeping the head cool and minimizing sweating thereof. It will also be noted that the arrangement provides a smooth surface in the areas of contact with the head W thereby eliminating any discomfort that might be at the back of the head in the area of the auxiliary sweat band 18.

Ordinarily, hats would have head size changes of 1/8 and in some instances head size changes from small, to medium, to large and extra large. The arrangement of this invention provides fine adjustment of the hat to make it most comfortable to the wearer.

While this invention has been described as having a preferred designs, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What is claimed is:

1. A size adjustable hat having:

a) a crown having exterior and interior surfaces, sides, front, back and a circumferential lower margin;

b) a sweat band having upper and lower edges, a central portion, inner and outer surfaces, front, back and sides;

c) said front, back and sides of said sweat band being juxtapositioned relative to said front, back and sides of said crown;

d) said sweat band's lower edge being circumferentially attached to said crown's circumferential lower margin;

e) said sweat band's upper edge and central portion being free and unattached to said crown;

f) said sweat band having on one side adjacent said sweat band's back a first opening and on the other side adjacent said sweat band's back a second opening spaced from said first opening;

g) an auxiliary sweat band having freeable and fixed ends;

h) said auxiliary sweat band's fixed end being secured on said sweat band's inner surface adjacent said first opening;

i) a first fastener fixedly secured to said sweat band's inner surface adjacent said second opening;

j) said auxiliary sweat band passing through said first opening and traveling adjacent said sweat band's outer surface to pass through said second opening and adjacent said sweat band's inner surface positioning said auxiliary sweat band's freeable end adjacent said sweat band's inner surface;

k) said freeable end of said auxiliary sweat band having a second fastener secured therewith for cooperative adjustable securement to said first fastener;

l) whereby when said auxiliary sweat band is moved said second opening during separation of said first and second fasteners, said hat size is adjusted and said adjustment is maintained upon cooperative engagement of said first and second fasteners.

2. A size adjustable hat as in claim 1 and wherein:

a) said first and second openings are slots.

3. A size adjustable hat as in claim 1 and wherein:

a) said first and second fasteners are cooperating hook and eye pads.

4. A size adjustable hat as in claim 3 and wherein:

a) said cooperating hook and eye pads are substantially the same length and width.

5. A size adjustable hat as in claim 4 and wherein:

a) said first fastener is slightly longer than said second fastener.

6. A size adjustable hat as in claim 3 and wherein:

a) said first and second fasteners are secured respectively to said sweat band and said auxiliary sweat band by stitching.

7. A size adjustable hat as in claim 1 and wherein:

a) first and second openings have proximate and remote sides, and b) said auxiliary sweat band is secured to said sweat band adjacent said remote side of said first opening.

8. A size adjustable hat as in claim 4 and wherein:

a) said first fastener is fixedly secured to said sweat band's inner surface adjacent said remote side of said second opening.

9. A size adjustable hat as in claim 1 and wherein:

a) said auxiliary sweat band is positioned between said upper and lower edges of said sweat band.

10. A size adjustable hat as in claim 1 and wherein:

a) said auxiliary sweat band comprises substantially the same material as said sweat band.

11. A size adjustable hat as in claim 10 and wherein:

a) said auxiliary sweat band and said sweat band form with one another a substantially smooth head contact surface.

* * * * *

UNITED STATES PATENT AND TRADEMARK OFFICE

CERTIFICATE OF CORRECTION

PATENT NO. : 5,426,789

DATED : June 27, 1995

INVENTOR(S) : Angus D. MacLeod

It is certified that error appears in the above-indentified patent and that said Letters Patent is hereby corrected as shown below:

Column 4,

Claim 1, subparagraph 1, after "moved" insert --in--.

Column 4,

Claim 8, line 1, delete "4" and insert therefor --7--.

Column 2, line 16, delete "2" and insert therefor --do--.

Column 2, line 7, delete "prostrates is" and insert therefor --illustrates an--, after "perspective" insert --of--.

Signed and Sealed this

Seventh Day of November, 1995

*Attest:*

*Attesting Officer*

Bruce Lehman

BRUCE LEHMAN

*Commissioner of Patents and Trademarks*